US008235793B2

(12) United States Patent
Pau

(10) Patent No.: US 8,235,793 B2
(45) Date of Patent: Aug. 7, 2012

(54) PRIZE AWARDING MECHANISM FOR A GAMING MACHINE OR SYSTEM OF LINKED GAMING MACHINES

(75) Inventor: Edgar Pau, Homebush (AU)

(73) Assignee: Aristocrat Technologies Australia Pty Limited, North Ryde, NSW (AU)

( * ) Notice: Subject to any disclaimer, the term of this patent is extended or adjusted under 35 U.S.C. 154(b) by 958 days.

(21) Appl. No.: 12/176,841

(22) Filed: Jul. 21, 2008

(65) Prior Publication Data

US 2009/0186691 A1 Jul. 23, 2009

(30) Foreign Application Priority Data

Jul. 27, 2007 (AU) ..... 2007904072

(51) Int. Cl.
*A63F 9/24* (2006.01)

(52) U.S. Cl. ..... 463/20; 463/27

(58) Field of Classification Search ..... 463/19, 463/25–30

See application file for complete search history.

(56) References Cited

U.S. PATENT DOCUMENTS

| | | | | |
|---|---|---|---|---|
| 2003/0199320 | A1* | 10/2003 | Nguyen et al. | 463/42 |
| 2005/0096130 | A1 | 5/2005 | Mullins | |
| 2006/0135254 | A1* | 6/2006 | Thomas | 463/25 |
| 2007/0191088 | A1* | 8/2007 | Breckner et al. | 463/20 |
| 2007/0218975 | A1* | 9/2007 | Iddings et al. | 463/25 |
| 2008/0108410 | A1* | 5/2008 | Baerlocher | 463/20 |

FOREIGN PATENT DOCUMENTS

| | | |
|---|---|---|
| AU | 771798 | 1/2002 |
| AU | 776584 | 4/2002 |

* cited by examiner

*Primary Examiner* — Masud Ahmed

(74) *Attorney, Agent, or Firm* — Hanley, Flight & Zimmerman, LLC

(57) ABSTRACT

Systems and methods for use with a gaming machine that, in response to the staking of a wager by a player, is arranged to randomly determine an outcome of a game, display on a display representations of the outcome, and award an award if a winning outcome occurs, wherein the player can stake a variable sized wager on the occurrence of a winning outcome, the systems and methods including varying the probability of selecting the outcome associated with a special prize dependent on the size of the wager staked by the player and/or varying the probability of one or more other prizes that are alternatives to the special prize.

16 Claims, 4 Drawing Sheets

PRIZE AWARDING MECHANISM FOR A GAMING MACHINE OR SYSTEM OF LINKED GAMING MACHINES

CROSS REFERENCE TO RELATED APPLICATIONS

This application is related to and claims the benefit of priority to Australian Provisional Patent Serial No. 2007904072, entitled "Prize Awarding Mechanism for a Gaming Machine or System of Linked Gaming Machines", filed Jul. 27, 2007, the content of which is herein incorporated by reference in its entirety.

FIELD OF THE INVENTION

The present invention generally relates to gaming machines and methods of gaming. A particular embodiment of the present invention relates to gaming machines that maintain a progressive prize and to a method of awarding a progressive prize.

BACKGROUND OF THE INVENTION

With the increase of gambling at gaming venues has come increased competition between gaming venues to obtain a larger share of the total gambling spend. Gaming venue operators have therefore continuously looked for new variations and types of games in order to attract both new and return customers to their venues.

In response to this need, suppliers of gaming devices and systems have attempted to provide the sought after variety, while still developing games that comply with the relevant regulations in the jurisdiction of the gaming venue operator. Suppliers of gaming devices therefore are faced with restrictions on the types of games and gaming machines that are allowable, both in terms of the prevailing regulations and in terms of providing a return on investment to the gaming venue operators.

Gaming machines that provide players with significant choices as to the wager that they wish to stake are now common. For example, in a spinning reel game in which reels carrying game symbols are randomly stopped in a certain position to define outcomes in the form of symbols along pay lines across the reels, players are often given the choice to wager on a variable number of pay lines and given the choice to wager a variable amount on each pay line. For example, in a first game play, the player may choose to wager 1 credit on three pay lines for a total wager of 3 credits and in a second game play the player may choose to wager 2 credits on ten pay lines, for a total wager of 20 credits. On a 1 cent denomination machine, the first wager would cost 3 cents and the second wager 20 cents. Typically, if a winning combination occurs along one of the three pay lines in the first game, the gaming machine awards the value specified by the prize schedule of the gaming machine, and if the same winning combination occurs along one of the ten pay lines in the second game, the gaming machine awards twice the value specified by the prize schedule.

Gaming machines that offer one or more special prizes, for example progressive prizes, large prizes, or non-monetary prizes have experienced widespread success. To offer a progressive prize, a gaming machine may contribute a certain percentage of wagers staked to a progressive prize, which is then won on a specific progressive prize winning event. An example of a prize winning event that has been used in the past is the occurrence of a particular combination of symbols.

Other methods of awarding progressive prizes and other prizes have been developed and there remains a need for new methods of awarding prizes. Such special prizes can not normally be multiplied depending on the wager staked.

In determining a method of awarding a prize, a game designer usually has to ensure that the gaming machine has a particular average return to player. For example the gaming machine, on average, may have to return approximately 85% of all wagers to the player as winnings. The increased options now available to players in many games played on gaming machines, including options to wager multiple credits per pay line or other outcome of a game and the option to simultaneously play multiple outcomes, together with other game features such as the possibility of winning a progressive prize, raises problems in determining how to achieve a required return to player, while providing a prize awarding method that is appropriate.

SUMMARY OF THE INVENTION

According to a first aspect, the invention broadly resides in a method for use with a gaming machine that, in response to the staking of a wager by a player, is arranged to randomly determine an outcome of a game, display on a display representations of the outcome, and award an award if a winning outcome occurs, wherein the player can stake a variable sized wager on the occurrence of a winning outcome, the method including varying the probability of selecting the outcome associated with a special prize dependent on the size of the wager staked by the player and/or varying the probability of one or more other prizes that are alternatives to the special prize.

According to a second aspect, the invention broadly resides in a method for use with a gaming machine that, in response to the staking of a wager by a player, is arranged to randomly determine an outcome of a game, display on a display representations of the outcome, and award an award if a winning outcome occurs, wherein the player can stake a variable sized wager on the occurrence of a winning outcome, the method including:

displaying on the display or on another display of the gaming machine a plurality of prize schedules, wherein:

a) each prize schedule defines a plurality of awards that are awarded on the occurrence of an associated winning outcome in the game, b) each prize schedule differs in at least one award from each of the other prize schedules, and c) at least one of the prize schedules includes a special prize;

receiving a selection of one of the prize schedules;

determining at least one outcome of the game and displaying representations of the outcome on the display; and when a winning outcome occurs in the determined outcomes, award the award in the selected prize schedule associated with that winning outcome;

wherein the process of determining at least one outcome of the game includes making a random selection from a plurality of outcomes that include each winning outcome in the selected prize schedule, wherein the probability of selecting the outcome associated with the special prize varies dependent on the size of the wager staked by the player so as to maintain a substantially equal expected return to player regardless of which prize schedule is selected and the size of the wager staked.

In one embodiment, the process of determining at least one outcome of a game and displaying representations of the outcome on the display is constrained to select an outcome that is associated with a prize in the selected prize schedule.

In one embodiment, the game is a feature game of a base game, wherein in each game play of the base game the player stakes a wager on the occurrence of a winning outcome of the base game, and if a trigger event occurs during play of the base game, the feature game commences, wherein in the feature game the wager that influences the probability of selecting the outcome associated with the special prize is a wager placed in the game play of the base game during which the trigger event occurred.

In one embodiment, the probability of winning the special prize is increased proportionally to the size of the wager. In this embodiment, all prizes in the prize schedules other than the special prize may maintain a fixed value.

In another embodiment, the probability of winning the special prize is not proportional to the size of the wager, and the overall expected return to player resulting from play of the game with the selected prize schedule is changed proportional to the size of the wager by varying the probability of winning at least one other prize in the prize schedule and/or by varying the value of at least one other prize in the prize schedule.

In one embodiment, at least two of the prize schedules each define a different special prize. In one version of this embodiment, all of the prize schedules may define a special prize, with no two prize schedules defining the same special prize. Also, in the process of determining at least one outcome of the game and displaying representations of the outcome on the display, the same representations may be used to indicate the winning of special prizes from different prize schedules.

In one embodiment, each prize schedule includes a single special prize.

In one embodiment, the method is applied to a gaming machine that is linked with at least one other gaming machine, and the method includes providing the game on each of the linked gaming machines so that each linked gaming machine is eligible to win the special prize. This embodiment may be particularly suited to implementation with the embodiment in which the game is a feature game. In this implementation, the base game may differ between different gaming machines.

According to a third aspect, the invention broadly resides in a gaming machine comprising a user interface and a game controller in communication with the user interface, the game controller providing a game in response to the staking of a wager by a player, by randomly determining an outcome of the game, displaying on a display of the user interface representations of the outcome, and causing the gaming machine to award an award if a winning outcome occurs, at least one award comprising a special prize, wherein the size of the wager staked by the player is variable and controllable by the player by operating the user interface, and wherein the game controller varies the probability of selecting an outcome associated with a special prize dependent on the size of the wager staked by the player and/or varies the probability of selecting one or more outcomes associated with one or more other prizes that can be awarded as alternatives to the special prize.

In one embodiment, the game controller determines outcomes of the game by receiving random numbers from a random number generator and comparing the received numbers with numbers associated with the outcomes, wherein the game controller varies the probability of selecting an outcome associated with a special prize by varying the range of numbers associated with the special prize.

According to a fourth aspect, the invention broadly resides in a gaming machine including a user interface in communication with a game controller that, in response to the staking of a wager by a player, is arranged to randomly determine an outcome of a game, cause a display of the user interface to display representations of the outcome, and award an award if a winning outcome occurs, wherein the player can stake a variable sized wager on the occurrence of a winning outcome by operating a user interface of the gaming machine, wherein:

the gaming machine displays on a display of the user interface a plurality of prize schedules, wherein:

a) each prize schedule defines a plurality of awards that are awarded on the occurrence of an associated winning outcome in the game, b) each prize schedule differs in at least one award from each of the other prize schedules, and c) at least one of the prize schedules includes a special prize;

in response to operation of the user interface, the game controller determines one of the prize schedules as operating for the current game play;

the game controller varies one or more game parameters so as to vary the probability of selecting the outcome associated with the special prize dependent on the size of the wager staked by the player, so as to maintain a substantially equal expected return to player regardless of which prize schedule is selected and regardless of the size of the wager staked by the player, and then determines at least one outcome of a game by making a random selection from a plurality of outcomes that include each winning outcome in the selected prize schedule.

In one embodiment, the gaming machine is one of a plurality of linked gaming machines and each of the plurality of linked gaming machines is eligible to win the special prize.

According to a fifth aspect, the invention broadly resides in instructions executable by a game controller to implement the method as described in the preceding paragraphs and to such instructions when stored in a storage medium readable by the game controller. The game controller may be a programmable logic device programmed to implement the method, an application specific integrated circuit configured to implement the method or another suitable controller.

As used herein, the term "special prize" is a prize that the game designer or operator does not wish to have multiplied by the bet or a component of the bet made in the game. Special prizes are often in form of progressive prizes, non-cash prizes or prizes that are large in comparison to other prizes winnable from the game.

Further aspects of the present invention and further embodiments of the aspects described in the preceding paragraphs will become apparent from the following description, given by way of example and with reference to the accompanying drawings.

Figure 1:
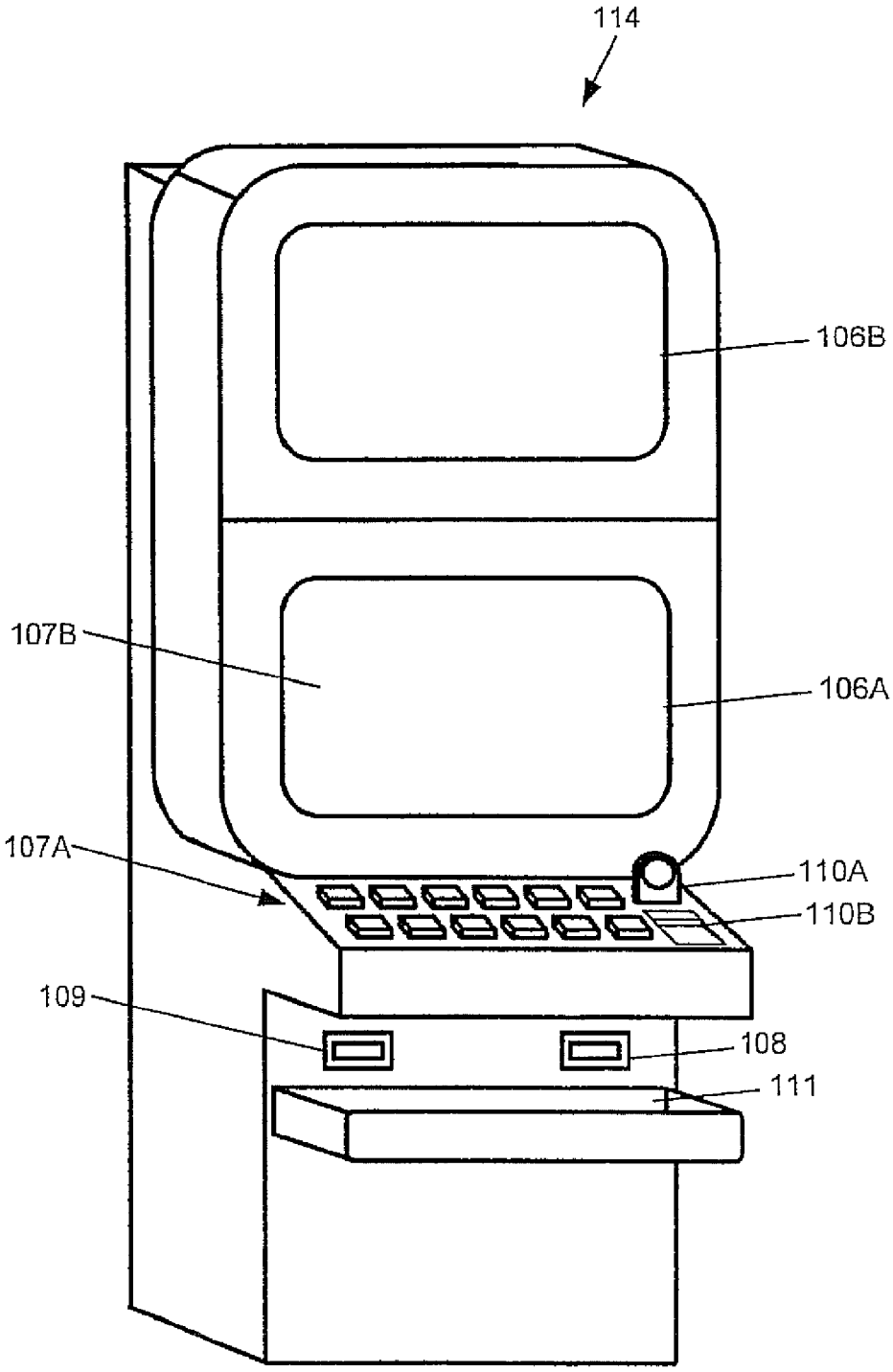
FIG. 1: shows diagrammatically, a view of a gaming console suitable for implementing certain embodiments of the present invention.

These and other features, aspects and advantages of the present invention will become better understood when the following detailed description is read with reference to the accompanying drawings in which like characters represent like part throughout the drawings. The embodiments shown in the drawings are presented for purposes of illustration only. It should be understood, however, that the present invention is not limited to the arrangements and instrumentality shown in the attached drawings.

DETAILED DESCRIPTION

In FIG. 1 of the accompanying drawings, one example of a gaming console that is suitable to implement certain embodiments of the present invention is generally referenced by arrow 114.

The gaming console 114 includes two displays 106A, 106B on one or both of which is displayed representations of a game that can be played by a player and a bank of buttons 107A and/or a touch screen 107B to enable a player to play the game. The displays 106 may be video display units, such as a cathode ray tube screen device, a liquid crystal display, plasma screen, any other suitable video display unit, or the visible portion of an electromechanical device. The display 106B may display artwork, including for example, pay tables and details of bonus awards and other information or images relating to the game. In alternative gaming consoles the display 106B may be omitted, optionally replaced by a static display.

A credit input including a coin input 110A and/or bill collector 110B allows a player to provide credit for wagering and a coin output 111 is provided for cash payouts from the gaming console 114. A card and/or ticket reader 108 and a printer 109 may be provided to provide player tracking, cashless game play or other gaming and non-gaming related functions.

Figure 2:
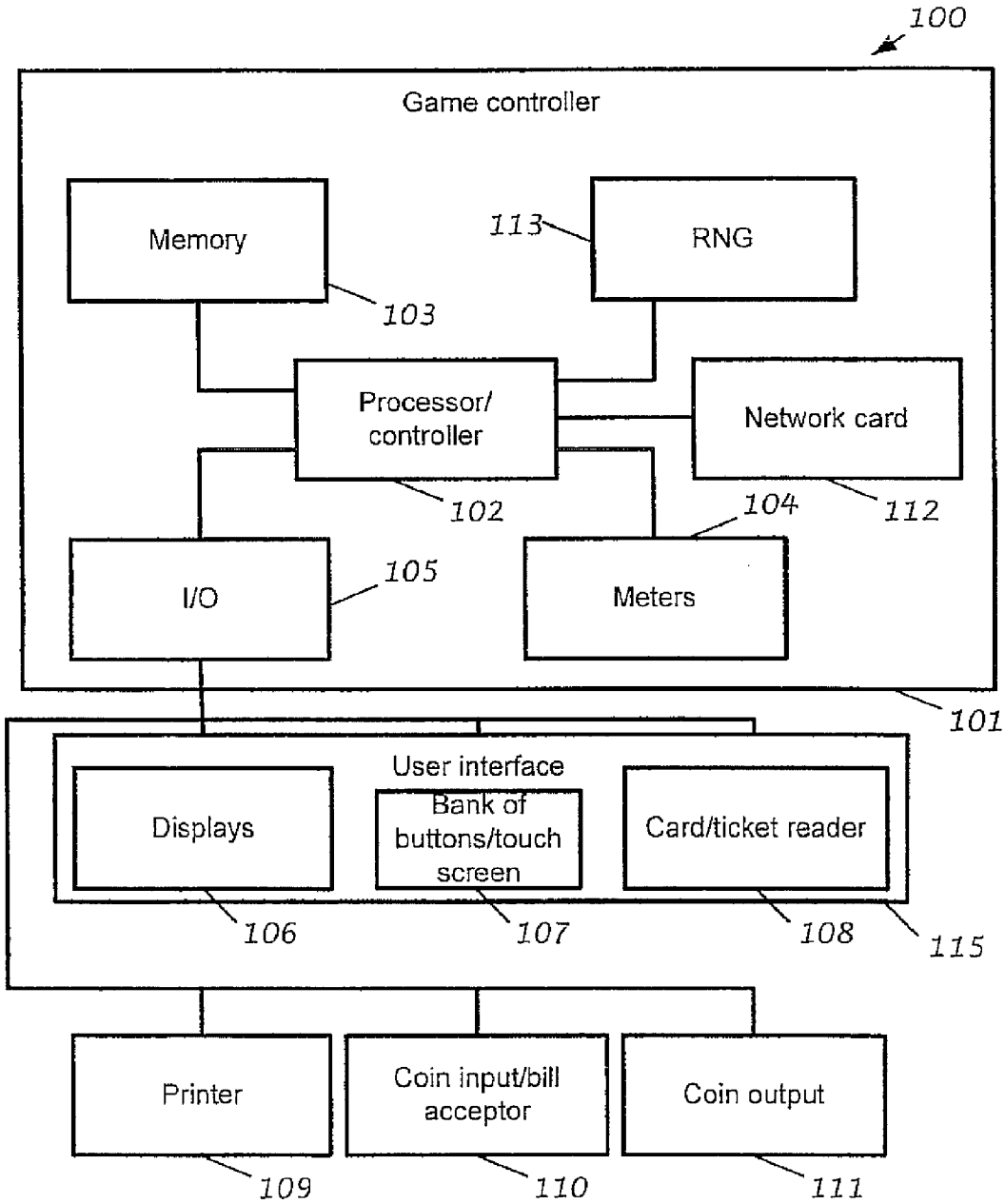
FIG. 2: shows a block diagram of gaming machine suitable for implementing certain embodiments of the present invention.

FIG. 2 shows a block diagram of a gaming machine, generally referenced by arrow 100, suitable for implementing certain embodiments of the present invention. The gaming machine 100 may include the gaming console 114 shown in FIG. 1 and accordingly like reference numerals have been used to describe like components in FIGS. 1 and 2.

The gaming machine 100 includes a game controller 101, which in the illustrated example includes a computational device 102, which may be a microprocessor, microcontroller, programmable logic device or other suitable device. Instructions and data to control operation of the computational device 102 are stored in a memory 103, which is in communication with, or forms part of, the computational device 102. Typically, the gaming machine 100 will include both volatile and non-volatile memory and more than one of each type of memory, with such memories being collectively represented by the memory 103. The instructions to cause the game controller 101 to implement the present invention will be stored in the memory 103.

The game controller 101 may include hardware credit meters 104 for the purposes of regulatory compliance and also include an input/output (I/O) interface 105 for communicating with the peripheral devices of the gaming machine 100. The input/output interface 105 and/or the peripheral devices may be intelligent devices with their own memory for instructions and data.

In the example shown in FIG. 2, the peripheral devices that communicate with the controller are the displays 106, bank of buttons/touch screen 107, the card and/or ticket reader 108, the printer 109, a bill acceptor and/or coin input 110 and a coin output 111. Additional devices may be included as part of the gaming machine 100, or devices omitted as required for the specific implementation.

The bank of buttons 107A and/or touch screen 107B together with one or both of the displays 106 may provide a user interface 115 through which the gaming machine 100 and player communicate. If a card/ticket reader 108 is provided, this may also form part of the user interface 115.

In addition, the gaming machine 100 may include a communications interface, for example a network card 112. The network card 112, may for example, send status information, accounting information or other information to a central controller, server or database and receive data or commands from the central controller, server or database. The network card 112 may also enable communication with a central player account, allowing cashless gaming. One or more of the peripheral devices, for example the card/ticket reader 108 may be able to communicate directly with the network card 112. The network card 112 and the I/O interface 105 may be suitably implemented as a single machine communications interface.

The game controller 101 may also include a random number generator 113, which generates a series of random numbers that are used by the computational device 102 to determine the outcomes of games played on the gaming machine 100.

The game controller 101 may have distributed hardware and software components that communicate with each other directly or through a network or other communication channel. The game controller 101 may also be located in part or in its entirety remote from the user interface 115. Also, the computational device 102 may comprise a plurality of devices, which may be local or remote from each other.

Figure 3:
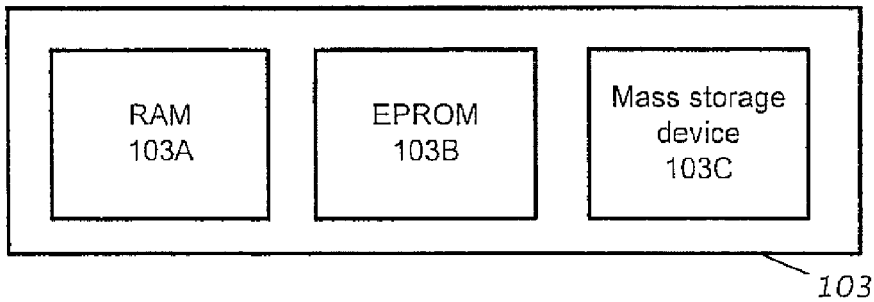
FIG. 3: shows a block diagram of components of the memory of the gaming machine represented in FIG. 2.

FIG. 3 shows an exemplary block diagram of the main components of the memory 103. The RAM 103A typically temporarily holds instructions and data related to the execution of game programs and communication functions performed by the computational controller 102. The EPROM 103B may be a boot ROM device and/or may contain system and game related code. The mass storage device 103C may be used to store game programs, the integrity of which may be verified and/or authenticated by the computational controller 102 using protected code from the EPROM 103B or elsewhere.

Figure 4:
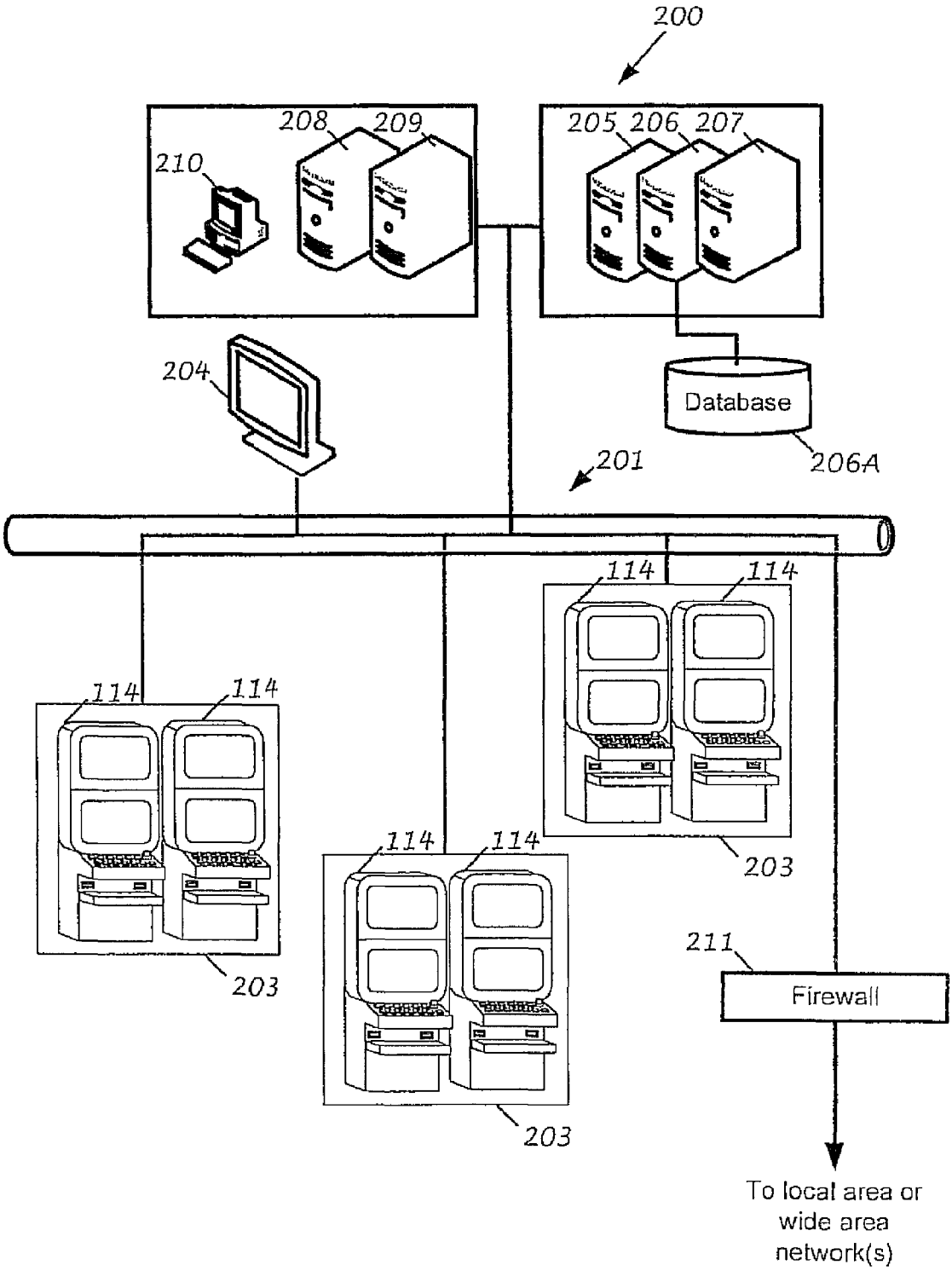
FIG. 4: shows diagrammatically, a network gaming system suitable for implementing certain embodiments of the present invention.

FIG. 4 shows a gaming system 200 in the form of a network of devices. The gaming system 200 includes a network infrastructure 201, which for example may be in the form of an Ethernet network. Alternatively, a wireless network and/or direct communication channels, or a different type of network may be used to link the gaming machines to a server, each other and/or other devices. Gaming consoles 114, shown arranged in three banks 203 of two gaming consoles 114 in FIG. 4, are connected to the network infrastructure 201. The gaming consoles 114 may form part or all of a gaming machine 100. Single gaming consoles 114 and banks 203 containing three or more gaming consoles 114 may also be connected to the network infrastructure 201, which may also include bank controllers, hubs, routers, bridges to other networks and other devices (not shown).

One or more displays 204 may also be connected to the network 201. The displays 204 may, for example, be associated with a bank 203 of gaming consoles 114. The displays 204 may be used to display representations associated with game play on the gaming consoles 114, and/or used to display other representations, for example promotional or informational material.

Servers may also be connected to the network 201. For example, a game server 205 may generate game outcomes for games played on one or more of the gaming consoles 114, a database management server 206 may manage the storage of game programs and associated data in a database 206A so that they are available for downloading to, or access by, game controllers 101, and a jackpot server 207 may control one or more jackpots for the gaming system 200.

Further servers may be provided to assist in the administration of the gaming system 200, including for example a gaming floor management server 208, and a licensing server 209 to monitor the use of licenses to particular games. An administrator terminal 210 is provided to allow an administrator to manage the network 201 and the devices connected to the network. The different servers depicted can be distinct physical servers or logically distinct server processes running on a single physical server.

The gaming system 200 may communicate with other gaming systems, other local networks, for example a corporate network and/or a wide area network such as the Internet through a firewall 211.

Certain embodiments of the present invention will now be described using the gaming machines described herein above and the gaming system shown in FIG. 4. The particular examples assume that each gaming console 114 includes a game controller 101 so as to form a gaming machine 100. Those skilled in the relevant arts will appreciate that certain embodiments of the present invention may be implemented in other gaming systems or machines.

A player plays a game at a gaming console 114. As described in more detail below, the game may be any one of a range of types of games. To play the game, the player stakes a wager on one or more outcomes of the game. For example, a player may stake a wager consisting of a bet of 2 credits on each of 10 pay lines in a spinning reel type game and completes this by operating the user interface 115, for example by pressing a bet selector button and a line selector button in the bank of buttons 107A.

The game includes a base game and a feature game. The player places his or her wager in the base game component and plays the base game, with the gaming machine 100 deducting and adding credits from and to the meters 104 as bets are made and credits are awarded as a result of a winning combination occurring. If the special prize or prizes include one or more progressive prizes, a percentage of the wagers is used to increment the progressive prizes. For example, the mini jackpot could be incremented at a rate of 0.5% of all wagers, the major jackpot at 1.0% and the maxi jackpot at 1.5%, so that the total increment rate across all three jackpots is 3.0%. As previously explained all of the special prizes do not need to be progressive prizes and in some embodiments none of the special prizes are progressive prizes. The feature game is commenced on the occurrence of a trigger event during play of the base game. Any suitable trigger event may be used, for example the occurrence of a particular symbol or combination of symbols in the base game. Those skilled in the relevant arts will appreciate that alternative trigger events may be used, which may be dependent on or independent of the occurrence of any particular outcome in the base game.

In some embodiments, before the player can be awarded the feature game, the player must have staked an eligible wager or bet. For example, the player may have to wager a certain minimum amount to be eligible for the feature game, the minimum amount specified with reference to the total amount of the wager, by the number of outcomes on which the player has staked a bet, and/or by the size of the bet wagered per outcome. In other embodiments the gaming machine 100 may award a feature on the occurrence of the trigger event for all possible wagers.

In one embodiment, the feature game is a second screen feature game displayed on a display 106, which is in the form of a video display screen. The screen presented by the display 106 changes and the player can see a plurality of prize schedules, for example three different prize schedules. For example, the prize schedules may present the information in Table A. The prize schedules may be stored in the memory 103 of the game controller 101. Alternatively, the prize schedules may be stored remote from the gaming machine 100 forming the gaming console 114, for example in or by the jackpot server 207 and communicated to the game controller 101 or the jackpot server 207 may take control of a display 106 of the gaming console 114. Similarly, the feature game may be locally controlled by the gaming machine 100, or remotely controlled, for example by the jackpot server 207 or the game server 205.

TABLE A

Exemplary prize schedules

| Finished position | Prize schedule A | Prize schedule B | Prize schedule C |
|---|---|---|---|
| 1 | Mini jackpot | Major jackpot | Maxi jackpot |
| 2 | 1000 | 400 | 100 |
| 3 | 400 | 300 | 60 |
| 4 | 300 | 200 | 50 |
| 5 | 200 | 100 | 40 |

In the example shown in Table A, all of the prize schedules include a single special prize. However, some prize schedules may consist of only ordinary prizes. Some schedules may include more than one special prize and in the limit may consist of entirely special prizes, although it is expected that in most practical implementations the special prizes would be limited to one or a few of the prizes in a prize schedule.

In one embodiment, all of the gaming consoles 114 that are eligible to win the special prizes listed in Table A play the same base game and the same feature game. However, they may play different base games, in which case the trigger event for the feature game may be selected so as to occur with a probability so that a required return to player is maintained for each game. The gaming consoles 114 may also play different format feature games, which may for example be themed to match the theme of the base game. Different screen base games and/or feature games may be playable at each gaming console 114, the games either being available directly from the game controller 101 (or the game server 205), or downloadable to the game controller 101 (or the game server 205) from the database management server 206.

By way of example, the second screen feature game may be presented as a car race and different prizes are awarded depending on where the player's car finishes in the race. Taking prize schedule A from Table A, if the player's car wins the race by finishing in position 1, then the player is awarded the 'mini jackpot', which is a special prize. If the player comes in 2nd to 5th, then the player is awarded the 'ordinary' (as opposed to 'special') prize corresponding to that position in prize schedule A.

For the ordinary prizes, the actual amount awarded is the prize value multiplied by the bet made per line in the base game. For example, if the player staked a wager including a bet of 2 credits per line in the base game that was being played when the trigger event occurred, selected prize schedule A, and in the feature game finished in position 3, then the player would be awarded 800 credits. The special prizes, which in the example schedules of Table A are the mini jackpot, major jackpot and maxi jackpot, are not multiplied by the bet made by the player in the base game.

As shown in the example in Table A, the prize schedules have ordinary prizes that are generally inversely related to the size of the special prizes. The schedule with the smallest special prize, the mini jackpot, has the largest ordinary prizes and the schedule with the largest special prize, the maxi jackpot, has the smallest ordinary prizes. Using this arrangement, the player is given a choice as to whether to play for a larger special prize, or a larger ordinary prize. In this way, a player who wishes to play for a small jackpot value can have a high chance of winning that jackpot and/or a high chance of winning other prizes of high value. A player who wishes to play for a large jackpot value will have a low chance of winning that value and/or high chance of winning other prizes of low value. It is not essential that each prize schedule has the same number of winning outcomes and further variability may be achieved by using schedules with differing numbers of prizes.

Following selection of the prize schedule, to play the example feature game of a race, the display 106 may show a race course and a plurality of cars or drivers, there being at least as many racers as there are prizes in the selected prize schedule. The player is asked to operate the user interface 115 to select a driver. However, selection of the driver in no way affects the outcome of the race.

The gaming machine then consults a weighting table for determining the probability of each outcome in the race. The weighting table is pre-programmed into the software, firmware or hardware of the game controller 101 or other device implementing the feature game, and as described in more detail below is related to both the prize schedule and the amount bet per line.

The RNG 113 is then used to determine the outcome of the feature game according the weighting table. The display 106 is then controlled to show the outcome of the race. If the player's driver comes first in the race, then the player wins the mini jackpot. Otherwise the player wins the prize advertised in the prize schedule. The prize is awarded, multiplied by the bet made in the base game if the prize was an ordinary prize, and the player returns to the main game. In one embodiment, the player always win a prize from the selected prize schedule, or in other words, the prize schedule lists every possible outcome from the feature game and each outcome is associated with a prize.

Each prize schedule can be formed to have approximately the same return to player. This means that for each prize schedule, the sum of each of the chances of winning each prize times the value of the prize divided by the bet is approximately the same regardless of which prize schedule was chosen. This may be expressed as equation 1:

$$rtp = \sum_{i=1}^{n} \frac{p_i V_i}{\text{bet}} \qquad \text{equation 1}$$

where:

rtp is the return to player of a prize schedule;

n is the total number of winning outcomes in the prize schedule;

$V_i$ is the value of the ith prize in the prize schedule;

$p_i$ is the probability of winning the ith prize in the prize schedule;

bet is the bet made in the base game.

Accordingly, a desired rtp for a prize schedule can be achieved by varying the values of $p_i$ and $V_i$. For non-cash prizes, the value of $V_i$ may be fixed and for progressive prizes the value of $V_i$ is statistically determined, based on the starting value of the progressive, the increment rate and the probability of occurrence of both the trigger event and the player winning the special prize from the feature game. For these types of prizes, the value of $p_i$ can be varied to obtain a desired rtp, or the values of the other prizes and/or probabilities of winning the other prizes set to achieve the desired rtp.

At least one prize schedule includes a special prize, which may be in the form of a progressive prize, a non-cash prize, or a large prize. More generally, a special prize is one that the game designer does not wish to have multiplied by the bet made in the game. For example, the value of a progressive prize, a non-cash prize, or a prize significantly larger than the other prizes available from game play is generally not multiplied.

Instead of multiplying the special prize by the bet made in the base game, the chance of winning the non-cash or progressive prize and/or the probability of winning other prizes in the prize schedule is changed depending on the bet. This change is effected through using the weighting table, which results in different probabilities of winning dependent on the bet. In one embodiment, the value of some of the prizes in the prize schedules may also be altered to ensure constant player return.

Taking the example of prize schedule A, then equation 1 is expanded out to form equation 2:

$$rtp_A = \frac{p_1 V_1}{\text{bet}} + \frac{p_2 1000}{\text{bet}} + \frac{p_3 400}{\text{bet}} + \frac{p_4 300}{\text{bet}} + \frac{p_5 200}{\text{bet}} \qquad \text{equation 2}$$

If it is assumed that the value of the ordinary prizes (1000, 400, 300 and 200 credits) are to remain fixed, and in the embodiment where the sum of $p_1$ to $p_5$ equals a constant value, for example 1 so that every instance of the feature game results in one of the prizes from prize schedule A, then for any given bet and a desired rtp, the desired $p_1$ is readily determined. Because the gaming machines have fixed options for the bet, then the value for $p_1 V_1$ for each bet can be determined and implemented using the fixed weighting table mentioned previously. For a progressive prize, the value of $V_1$ is a function of the seed value of the progressive, the increment rate and the product of the probabilities of occurrence of the trigger event and $p_1$. Accordingly, by substitution the value of $p_1$ can be determined.

When the values of $p_1$-$p_4$ have all been determined, then ranges of numbers can be assigned to each outcome depending on that probability, the total range being within or matching the range of numbers generated by the RNG 113, so that the outcome of the feature game is determined by the first number that the RNG 113 generates that is within one of the ranges assigned to an outcome.

The probability of triggering the feature game may be fixed, for example when the occurrence of the trigger is independent of the bet, in which case the trigger event may be the occurrence of an outcome that displays a special symbol or combination of special symbols anywhere on the displayed portions of the spinning reels. Alternatively, the probability of triggering the feature game may be variable dependent on the bet, for example when the trigger event is a particular combination of symbols occurring along a line that the player has bet on.

In other embodiments, $p_2$ to $p_4$ may be changed depending on the bet made and $V_2$-$V_4$ may also be changed. In a still further embodiment, $V_2$-$V_4$ may not be multiplied by the base bet, which adds further variability to the pay schedule to achieve a desired rtp. These variations, in addition to the option to provide variability in the probability of occurrence of the trigger event that triggers the feature game lead to additional complexity and in many instances no unique solution as to how to set the prize schedules. Various techniques may be used to arrive at a prize schedule that maintains at least an approximately constant rtp regardless of the bet made. A simple example is to use a trial and error approach to set values for all but one of $p_1$ to $p_4$ and $V_1$ to $V_4$ and then determine the required value for the final variable, adjusting the set values if the desired value of the final variable is not suitable.

Embodiments of the invention may be applied to various types of games provided using the gaming consoles 114. For example, the gaming consoles 114 concept can also be used on the following types of games as follows:—

Steppers and Video Spinning Reel Games

In addition to implementation using video displays 106A and optionally also 106B, to provide a second screen feature game, steppers can be used for the base game and/or the feature game. The feature game could be played on a video screen associated with the stepper display, or alternatively a stepper mechanism can offer a feature game itself, for example by offering "nudges", or "respins" to obtain an outcome in a prize schedule.

For "nudges", once the trigger event occurs, the player may be able to move one or more reels along one or more positions to achieve an outcome from the prize schedule for the feature game. When the trigger event is a combination of symbols, the reels may be configured so that there are at least as many trigger combinations as there are outcomes of the feature game, preferably more to allow variable probability between outcomes in the feature game, so that different feature outcomes are achievable by nudging from the combination of symbols that represent the trigger event. For "respins", the probability of each feature outcome is determined in the same way as for the base game.

Unless the probability of the stopping position of the physical reels is altered, in implementations where the feature game is a stepper, then the prize values of the prize schedules would be varied depending on the bet made in the base game, the variation being made to maintain a constant rtp having regard to the special prize(s) offered. Games essentially identical to these stepper implementations could be implemented using one or more video displays.

Card Games

The base game could also be a card game, with a second screen feature game as described above.

If the feature game is to be implemented as a card game, the player can choose which winning hand to chase, again with the choice having no influence on the outcome of the feature game.

Dice Games

The base game could be a dice game, with the feature game being a second screen game.

If the feature game is implemented as a dice game, the player can choose which combinations to roll for.

Similarly for keno games, the player can choose how many patterns to play for, in bingo games, the player can choose which number pattern to play for and in pin and ball (arishinko) games, the player can choose how many buckets to land or how many black holes to fill.

The player may not be given any choice as to which car, driver, combination etc for the feature game, this step not being essential because the choice has no influence on the outcome of the feature game. However, this choice component may add a level of entertainment to the game.

Figure 5:
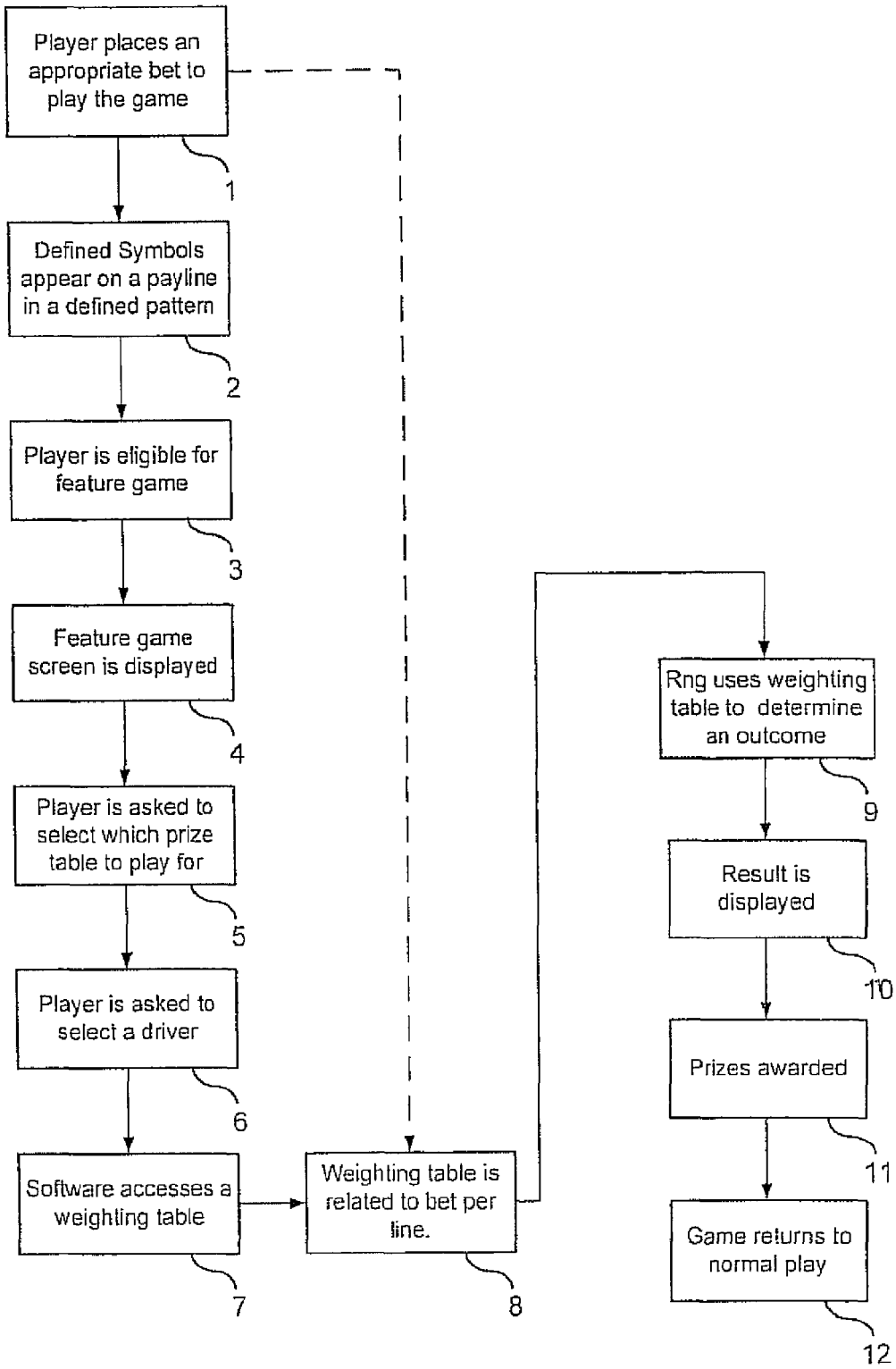
FIG. 5: shows a flow diagram of a process performed in accordance with an embodiment of the present invention.

FIG. 5 shows a process flow diagram of the process described above. In step 1, the game controller 101 monitors the bill acceptor and/or coin input 110 and/or information received by the card/ticket reader 108 or network card 112 for a deposit of credit and in response causes the hardware meters 104 to increment according to the denomination of the game. The game controller 101 then monitors the user interface 115 for the input of a wager and controls play of the base game.

When during play of the base game a trigger event occurs such as the display of defined symbols on a pay line in a specific pattern or order, as indicated by step 2, the game controller 101 checks whether the player is eligible for the feature game, for example checking that any requirements for a minimum size wager have been met (step 3) and them progresses to step 4. Step 3 may be omitted if there are no limitations on eligibility.

In steps 4 and 5 the feature game screen is displayed and a prompt is displayed asking the player to select a prize schedule, during which, for example, the player may choose one of the prize schedules shown in Table A described herein. In some embodiments, the option provided by step 5 may be omitted so that only a single prize schedule is maintained. In optional step 6, the player is asked to select a driver, which may influence the presentation of the feature game to the player, but not the outcome of the game.

In steps 7 and 8 the software (or firmware, or hardware), determines the probability of occurrence of each outcome in the feature game and in step 9, the computational device 102 receives a random number from the RNG 113 and compares this to the table identified in steps 7 and 8 to determine the outcome of the feature game. Representations of the outcome are displayed on the display in step 10, taking into account any variability to those representations that may be provided based on the player's selection at step 6 and/or step 5. The gaming machine 100 then pays the prize according to the prize schedule selected in step 5, as described hereinbefore. The feature game is then completed and in step 12 the game returns to play of the base game, optionally any other features that may be added, for example a 'double or nothing' feature.

As indicated by the dashed arrow in FIG. 5, the prize award mechanism need not necessarily be from a feature game and may be instead implemented directly in the base game. Taking again the example prize schedule A in Table A, the base game may use this prize schedule for different outcomes in the base game. The probability of winning the special prize directly from the base game may then be dependent on the wager placed. Alternatively, the probability of winning one or more of the ordinary prizes and/or the value of one or more of the ordinary prizes may be varied dependent on the wager placed, either in addition to or instead of varying the probability of winning the special prize. The player may still be offered the choice in step 5, this choice being instead offered before step 1 or between steps 1 and 8.

While the foregoing description has been provided by way of example of certain embodiments of the present invention as presently contemplated, which utilise gaming machines of the type found in casinos, those skilled in the relevant arts will appreciate that the present invention also may have application to internet gaming and/or have application to gaming over a telecommunications network, where handsets are used to display game outcomes and receive player inputs.

Where in the foregoing description reference has been made to integers having known equivalents, then those equivalents are hereby incorporated herein as if individually set forth.

Those skilled in the relevant arts will appreciate that modifications and additions to the embodiments of the present invention may be made without departing from the scope of the present invention.

It will be understood that the invention disclosed and defined in this specification extends to all alternative combinations of two or more of the individual features mentioned or evident from the text or drawings. All of these different combinations constitute various alternative aspects of the invention.

It will also be understood that the term "comprises" (or its grammatical variants) as used in this specification is equivalent to the term "includes" and should not be taken as excluding the presence of other elements or features.

Several embodiments are described above with reference to drawings. These drawings illustrate certain details of specific embodiments that implement the systems and methods and programs of the present invention. However, describing the invention with drawings should not be construed as imposing on the invention any limitations associated with features shown in the drawings. The present invention contemplates methods, systems and program products on any machine-readable media for accomplishing its operations. As noted above, the embodiments of the present invention may be implemented using an existing computer processor, or by a special purpose computer processor incorporated for this or another purpose or by a hardwired system.

As noted above, embodiments within the scope of the present invention include program products comprising machine-readable media for carrying or having machine-executable instructions or data structures stored thereon. Such machine-readable media can be any available media that can be accessed by a general purpose or special purpose computer or other machine with a processor. By way of example, such machine-readable media may comprise RAM, ROM, PROM, EPROM, EEPROM, Flash, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such a connection is properly termed a machine-readable medium. Combinations of the above are also included within the scope of machine-readable media. Machine-executable instructions comprise, for example, instructions and data which cause a general purpose computer, special purpose computer, or special purpose processing machines to perform a certain function or group of functions.

Embodiments of the invention are described in the general context of method steps which may be implemented in one embodiment by a program product including machine-executable instructions, such as program code, for example in the form of program modules executed by machines in networked environments. Generally, program modules include routines, programs, objects, components, data structures, etc., that perform particular tasks or implement particular abstract data types. Machine-executable instructions, associated data structures, and program modules represent examples of program code for executing steps of the methods disclosed herein. The particular sequence of such executable instructions or associated data structures represents examples of corresponding acts for implementing the functions described in such steps.

The invention claimed is:

1. A method for use with a gaming machine that, in response to the staking of a wager by a player, is arranged to randomly determine an outcome of a game, display on a display representations of the outcome, and award an award if a winning outcome occurs, wherein the player can stake a variable sized wager on the occurrence of a winning outcome, the method including:

displaying a plurality of prize schedules for selection by the player, each prize schedule including a plurality of prizes and at least one special prize; receiving a selection of a prize schedule from the player;

varying the probability of an outcome associated with the special prize and one or more other prizes in the selected prize schedule, wherein each of the plurality of prize schedules are formed to have the same rate of return to the player (RTP), the RTP being calculated based on the probability of an outcome in proportion to the size of the wager staked by the player; wherein the probability of winning the special prize in the selected prize schedule is held constant, and the RTP of the game is maintained by varying the value of the special prize in the selected prize schedule, the RTP being calculated based on the value of the special prize in the prize schedule in proportion to the size of the wager staked by the player.

2. The method of claim 1 wherein the process of determining an outcome of the game and displaying representations of the outcome on the display is constrained to select an outcome that is associated with a prize in the selected prize schedule.

3. The method of claim 1 wherein the game is a feature game of a base game, wherein in each game play of the base game the player stakes a wager on the occurrence of a winning outcome of the base game, and if a trigger event occurs during play of the base game, the feature game commences, wherein in the feature game the wager that influences the probability of selecting the outcome associated with the special prize is a wager placed in the game play of the base game during which the trigger event occurred.

4. The method of claim 1 wherein the probability of winning the special prize is increased proportionally to the size of the wager.

5. The method of claim 4 wherein all prizes in the prize schedules other than the special prize maintains a fixed value.

6. The method of claim 1 wherein at least two of the prize schedules each define a different special prize.

7. The method of claim 6 wherein no two prize schedules define the same special prize.

8. The method of claim 6 wherein in the process of determining at least one outcome of the game and displaying representations of the outcome on the display, the same representations is used to indicate the winning of special prizes from different prize schedules.

9. The method of claim 1 wherein each prize schedule includes a single special prize.

10. The method of claim 1 wherein the method is applied to a gaming machine that is linked with at least one other gaming machine, and the method includes providing the game on each of the linked gaming machines so that each linked gaming machine is eligible to win the special prize.

11. The method of claim 10 wherein the base game differs between different gaming machines.

12. A gaming machine comprising a user interface and a game controller in communication with the user interface, the game controller providing a game in response to the staking of a wager by a player, by randomly determining an outcome of the game, displaying on a display of the user interface representations of the outcome, and causing the gaming machine to award an award if a winning outcome occurs, at least one award comprising a special prize, wherein the size of the wager staked by the player is variable and controllable by the player by operating the user interface, and wherein the game controller:

displays a plurality of prize schedules for selection by the player, each prize schedule including a plurality of prizes and at least one special prize; receives a selection of a prize schedule from the player; and varies the probability of an outcome associated with the special prize and one or more other prizes in the selected prize schedule, wherein each of the plurality of prize schedules are formed to have the same rate of return to the player (RTP), the RTP being calculated based on the probability of an outcome in proportion to the size of the wager staked by the player; wherein the probability of winning the special prize in the selected prize schedule is held constant, and the RTP of the game is maintained by varying the value of the special prize in the selected prize schedule, the RTP being calculated based on the value of the special prize in the prize schedule in proportion to the size of the wager staked by the player.

13. The gaming machine of claim 12 wherein the game controller determines outcomes of the game by receiving random numbers from a random number generator and comparing the received numbers with numbers associated with the outcomes, wherein the game controller varies the probability of selecting an outcome associated with a special prize by varying the range of numbers associated with the special prize.

14. The gaming machine of claim 12 wherein the gaming machine is one of a plurality of linked gaming machines and each of the plurality of linked gaming machines is eligible to win the special prize.

15. The method of claim 12 wherein all prizes in the prize schedules other than the special prize maintains a fixed value.

16. A computer readable storage medium including instructions for execution by a processor, the instructions, when executed, implementing a method for use with a gaming machine that, in response to the staking of a wager by a player, is arranged to randomly determine an outcome of a game, display on a display representations of the outcome, and award an award if a winning outcome occurs, wherein the player can stake a variable sized wager on the occurrence of a winning outcome, the method including:

displaying a plurality of prize schedules for selection by the player, each prize schedule including a plurality of prizes and at least one special prize; receiving a selection of a prize schedule from the player; varying the probability of an outcome associated with the special prize one or more other prizes in the selected prize schedule, wherein each of the plurality of prize schedules are formed to have the same rate of return to the player (RTP), the RTP being calculated based on the probability of an outcome in proportion to the size of the wager staked by the player; wherein the probability of winning the special prize in the selected prize schedule is held constant, and the RTP of the game is maintained by varying the value of the special prize in the selected prize schedule, the RTP being calculated based on the value of the special prize in the prize schedule in proportion to the size of the wager staked by the player.

* * * * *